US006067992A

United States Patent [19]

Spatafora

[11] Patent Number: 6,067,992

[45] Date of Patent: May 30, 2000

[54] CIGARETTE MANUFACTURING MACHINE HAVING A SHAVING DEVICE

[75] Inventor: Mario Spatafora, Bologna, Italy

[73] Assignee: G.D Societa' per Azioni, Bologna, Italy

[21] Appl. No.: 09/354,949

[22] Filed: Jul. 16, 1999

[30] Foreign Application Priority Data

Jul. 22, 1998 [IT] Italy ..... BO98A0455

[51] Int. Cl.[7] ..... A24C 5/18

[52] U.S. Cl. ..... 131/84.4; 131/83.1; 131/84.1; 83/155.1; 83/122; 83/931

[58] Field of Search ..... 131/84.1, 84.4, 131/83.1, 108, 84.2, 84.3; 493/39; 408/203; 83/100, 155.1, 931, 122

[56] References Cited

U.S. PATENT DOCUMENTS

| | | | |
|---|---|---|---|
| 1,253,015 | 1/1918 | Driscoll . | |
| 2,660,178 | 11/1953 | Rault | 131/84 |
| 4,651,755 | 3/1987 | Rudszinat | 131/84.4 |
| 5,003,996 | 4/1991 | Tallier | 131/84.2 |
| 5,325,874 | 7/1994 | Heitmann | 131/84.4 |
| 5,526,826 | 6/1996 | Heitmann | 131/84.4 |
| 6,009,879 | 1/2000 | Vuilleumier | 131/84.2 |

FOREIGN PATENT DOCUMENTS

| | | |
|---|---|---|
| 0 354 874 | 2/1990 | European Pat. Off. . |
| 0 645 098 | 3/1995 | European Pat. Off. . |

*Primary Examiner*—James Derrington
*Assistant Examiner*—Mark Halpern
*Attorney, Agent, or Firm*—Marshall, O'Toole, Gerstein, Murray & Borun

[57] ABSTRACT

A cigarette manufacturing machine having a shaving device for shaving a bead of tobacco fed along a given path, wherein two tubular shaving bodies, arranged eccentrically one inside the other and having respective serrated annular end edges having a tangent portion located along the path of the bead, are rotated at different angular speeds about axes substantially parallel to the path to shave the bead; the inner tubular shaving body communicating pneumatically with a suction device.

10 Claims, 2 Drawing Sheets

CIGARETTE MANUFACTURING MACHINE HAVING A SHAVING DEVICE

The present invention relates to a cigarette manufacturing machine.

BACKGROUND OF THE INVENTION

On cigarette manufacturing machines, a continuous bead of tobacco is fed, normally by means of a suction conveyor belt, onto a forming beam, at the input of which, the tobacco bead is fed onto a continuous paper strip which is gradually folded transversely about the bead along the forming beam to form a continuous cigarette rod.

To maintain a constant amount of tobacco along the bead, the machine is equipped with a shaving device, which interferes with the bead as this is fed towards the forming beam, so as to obtain a substantially constant bead section.

U.S. Pat. No. 5,325,874 describes a shaving device comprising two parallel, counter-rotating disks with respective peripheral portions tangent to each other at a point along the path of the tobacco bead. The counter-rotating disks have sharp edges for detaching the surplus tobacco from the bead, which surplus is then removed by a cutter and fed to the input of a tobacco collecting device.

Though highly efficient, the above shaving device has a relatively bulky structure, both crosswise to the tobacco bead, on account of the two side by side counter-rotating disks, and parallel to the tobacco bead, on account of the cutter for removing the surplus tobacco detached by the two counter-rotating disks.

The above shaving device also has a fairly complex, and therefore high-cost, structure on account of the surplus tobacco cutter.

One solution to the above drawback is proposed in U.S. Pat. No. 2,660,178, which describes a shaving device having two superimposed blades oscillating with respect to each other in a direction crosswise to the traveling direction of the tobacco bead. Each blade has a serrated edge contacting the tobacco bead, and which cooperates with the serrated edge of the other blade to cut the surplus tobacco.

Though relatively compact, the reciprocating movement of the above shaving device results in severe vibration—especially at the high operating speeds of modern manufacturing machines—which in turn reduces the working life of the device itself.

SUMMARY OF THE INVENTION

It is an object of the present invention to provide a shaving device for shaving a bead of tobacco, designed to eliminate the aforementioned drawbacks, and which at the same time is cheap and easy to produce.

According to the present invention, there is provided a cigarette manufacturing machine comprising supply means for feeding a bead of tobacco along a given path; and a shaving device located along said path to shave said bead, and which in turn comprises two tubular shaving bodies arranged one inside the other with the respective axes substantially parallel to each other; said two tubular shaving bodies having respective serrated annular end edges having a mutually tangent portion located along said path; and actuating means being provided to impart to said two tubular shaving bodies a relative speed with respect to each other.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
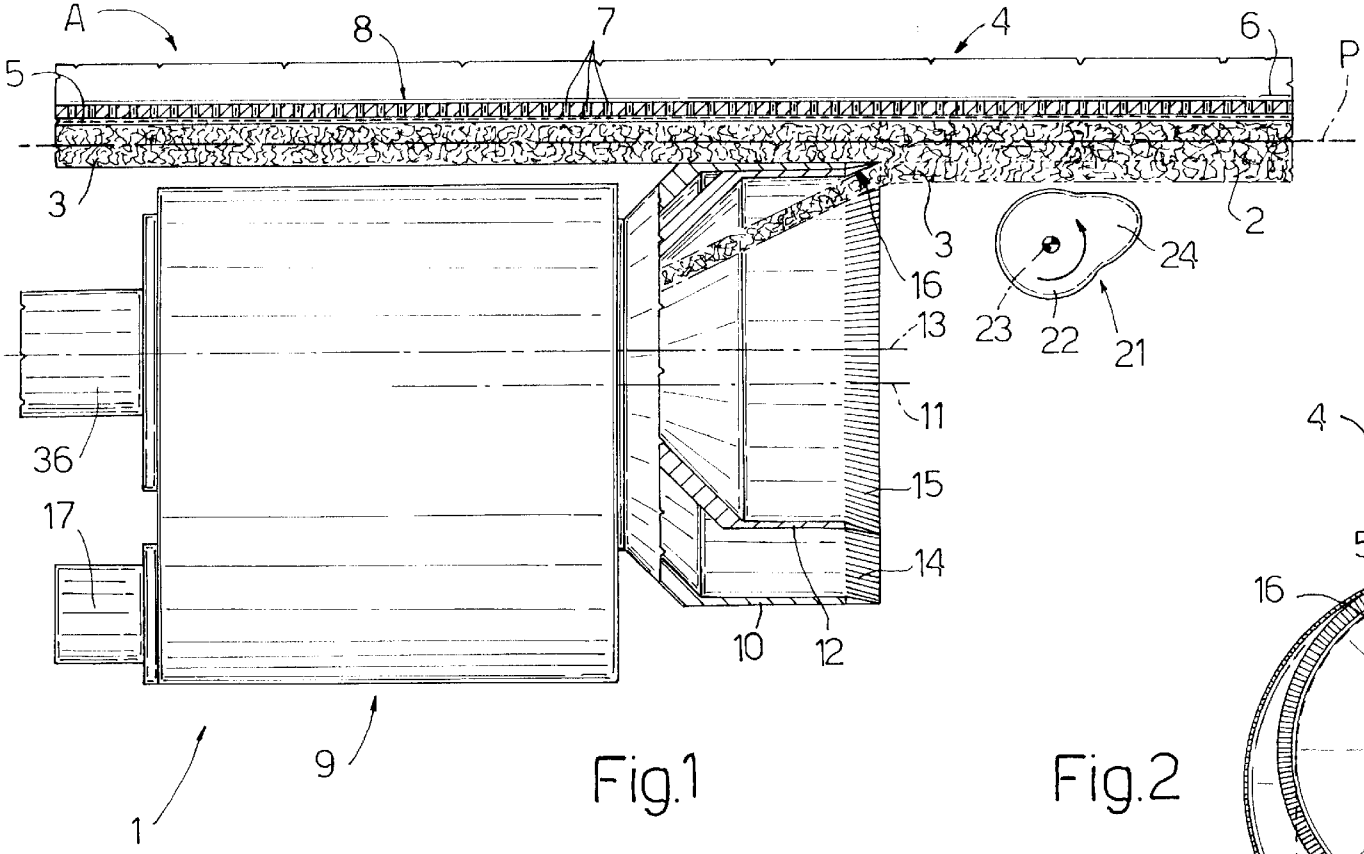
FIG. 1 shows a side view of a detail of a manufacturing machine featuring a shaving device in accordance with the present invention.
Figure 2:
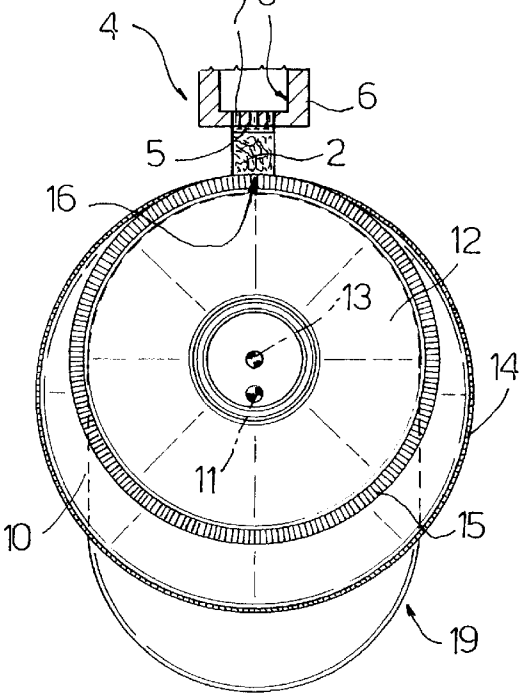
FIG. 2 shows a front view of the FIG. 1 device.

FIG. 1 shows a cigarette manufacturing machine A comprising a shaving device 1 for shaving a bead 2 of tobacco 3 fed along a path P by a supply device 4 comprising a suction conveyor belt 5 traveling along a supporting beam 6, which extends along path P and has a number of holes 7 communicating with an inner chamber 8 in which a vacuum is maintained in known manner with respect to the outside atmosphere. In the example embodiment shown, bead 2 is located beneath belt 5, and beam 6 is a suction supporting beam located over belt 5.

Shaving device 1 comprises a cylindrical frame 9 supporting a tubular shaving body 10 mounted for rotation about an axis 11 parallel to path P. Frame 9 also supports a tubular shaving body 12 mounted for rotation about an axis 13 parallel to axis 11, and which is smaller in diameter than body 10 so as to be housed eccentrically inside body 10.

Bodies 10 and 12 have respective serrated annular end edges 14 and 15 having a substantially mutually tangent portion 16 along path P, and are connected to a motor 17 via a transmission 18 capable of rotating bodies 10 and 12 about respective axes 11 and 13 in the same rotation direction and at different angular speeds. Despite substantially contacting each other, bodies 10 and 12 are capable of sliding with respect to each other in the neighborhood of portion 16.

Figure 4:
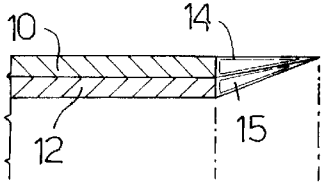
FIG. 4 shows a larger-scale view of a detail in FIG. 3.
Figure 5:
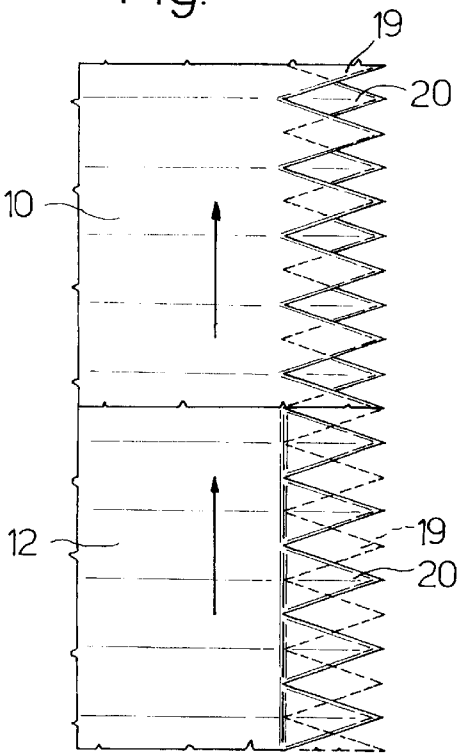
FIG. 5 shows a larger-scale plan view of a further detail in FIG. 3.

As shown clearly in FIGS. 4 and 5, edges 14 and 15 comprise respective successions of teeth 19 and 20, which are superimposed in the neighborhood of portion 16 to interface with based 2 along path P. More specifically, as bodies 10 and 12 rotate at different speeds about respective axes 11 and 13, teeth 19 and 20 intersect to "scissor" cut the fibers of tobacco 3 fed onto portion 16 by supply device 4.

As shown in FIG. 1, shaving device 1 also comprises a known compacting device 21 located along path P, immediately upstream from portion 16 in the traveling direction of bead 2 of tobacco 3, to form in bead 2 an orderly succession of higher-density portions located at successive cutting lines of bead 2 to compact tobacco 3 in known manner at the tips of the cigarettes (not shown).

Compacting device 21 comprises a substantially cylindrical body 22, which is powered to rotate, in time with the forward travel of bead 2, about an axis 23 crosswise and close to path P, and has a projection 24 for cyclically compressing a portion of tobacco 3 in bead 2.

Figure 3:
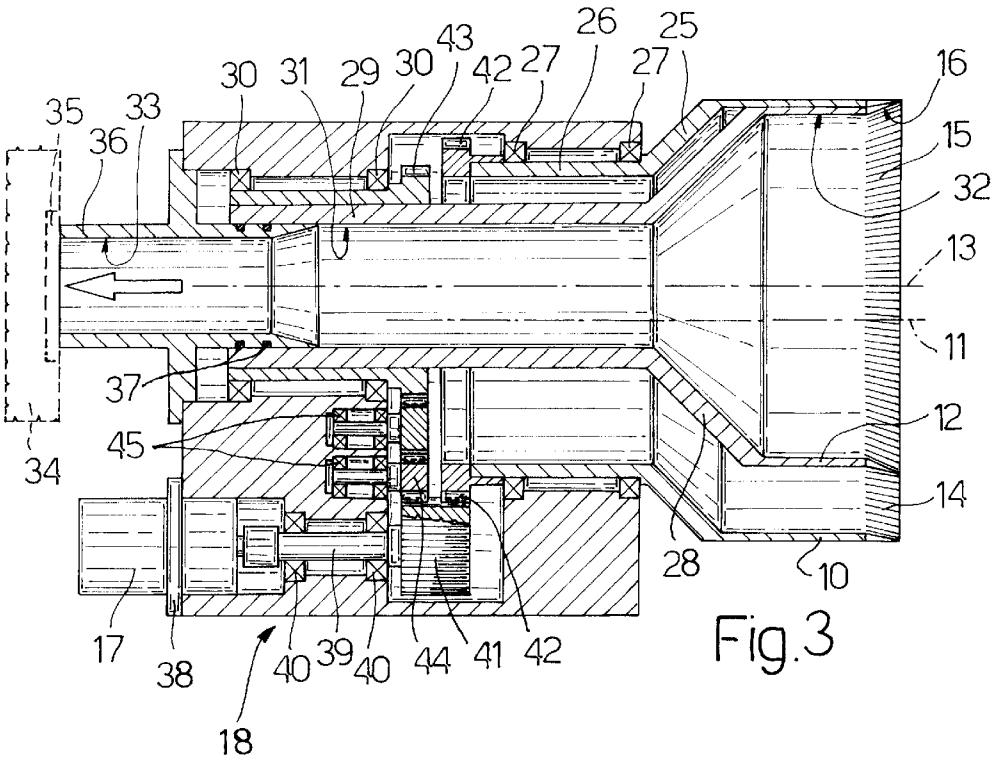
FIG. 3 shows a section of a detail in FIG. 1.

As shown in FIG. 3, body 10 is connected by a flared, funnel-shaped tubular fitting 25 to a hollow shaft 26, which is smaller in diameter than body 10 and fitted to frame 9 by means of a pair of thrust bearings 27; and body 12 is connected by a flared, funnel-shaped tubular fitting 28 to a hollow shaft 29, which is smaller in diameter than body 12 and fitted to frame 9 by means of a pair of thrust bearings 30.

Hollow shaft 29 has an inner conduit 31 connecting a central hole 32 in body 12 to an input channel 33 of a tobacco collecting unit 34, which comprises a suction device 35 for generating a vacuum inside channel 33 to convey the tobacco particles detached from bead 2 to collecting unit 34. Input channel 33 is defined by a tubular element 36 connected rigidly to frame 9 and connected in rotary manner to shaft 29 via the interposition of a pair of sealing rings 37.

Motor 17 is connected rigidly to frame 9 by a flange 38 and rotates a shaft 39 fitted to frame 9 by means of a pair of bearings 40 and angularly integral with a gear 41, which is connected directly to a ring gear 42 fitted to the outside of shaft 26, and is connected to a ring gear 43 fitted to the outside of shaft 29 via the interposition of a pair of intermediate gears 44 fitted idly to respective bearings 45.

The two connections between gear 41 and ring gear 42 and between gear 41 and ring gear 43 rotate respective shafts 26 and 29, and therefore respective bodies 10 and 12, about respective axes 11 and 13 in the same direction and at different angular speeds so as to slide edges 14 and 15 with respect to each other.

In a different embodiment not shown, motor 17 rotates bodies 10 and 12 in opposite directions about respective axes 11 and 13; and, in a further embodiment not shown, body 10, 12 is fixed and only the other body 12, 10 rotates about respective axis 13, 11.

Operation of shaving device 1 is clearly deducible from the foregoing description with no further explanation required.

In a different embodiment not shown, the shaving bodies 10 and 12 are arranged coaxially one inside the other.

What is claimed is:

1. A cigarette manufacturing machine comprising supply means (4) for feeding a bead (2) of tobacco (3) along a given path (P); and a shaving device (1) located along said path (P) to shave said bead (2), and which in turn comprises two tubular shaving bodies (10, 12) arranged one inside the other with the respective axes (11, 13) substantially parallel to each other; said two tubular shaving bodies (10, 12) having respective serrated annular end edges (14, 15) having a mutually tangent portion (16) located along said path (P); and actuating means (17) being provided to impart to said two tubular shaving bodies (10, 12) a relative speed with respect to each other.

2. A machine as claimed in claim 1, wherein said two tubular shaving bodies (10, 12) are arranged eccentrically one inside the other.

3. A machine as claimed in claim 1, wherein said two tubular shaving bodies (10, 12) are arranged coaxially one inside the other.

4. A machine as claimed in claim 1, wherein the axes (11, 13) of said two tubular shaving bodies (10, 12) are substantially parallel to said path (P).

5. A machine as claimed in claim 1, wherein at least a first (10; 12) of said two tubular shaving bodies (10, 12) is mounted for rotation about the respective said axis (11; 13); said actuating means (17) being connected at least to said first tubular shaving body (10; 12) to rotate the first tubular shaving body (10; 12) about the respective axis (11; 13).

6. A machine as claimed in claim 1, wherein each of said two tubular shaving bodies (10, 12) is mounted for rotation about the respective said axis (11; 13); said actuating means (17) being connected to both said tubular shaving bodies (10, 12) to rotate each tubular shaving body (10; 12) about the respective axis (11; 13).

7. A machine as claimed in claim 6, wherein said actuating means (17) are connected to both said two tubular shaving bodies (10, 12) to rotate the two tubular shaving bodies (10, 12) about the respective axes (11, 13) in the same rotation direction and at different angular speeds.

8. A machine as claimed in claim 1, comprising a compacting device (21) located along said path (P), immediately upstream from said mutually tangent portion (16) in a traveling direction of the bead (2) of tobacco (3).

9. A machine as claimed in claim 1, wherein the inner tubular shaving body (12) communicates pneumatically with a suction device (35).

10. A machine as claimed in claim 1, wherein the inner tubular shaving body (12) has a central hole (32); the shaving device also comprising a tobacco collecting unit (34), a conduit (31) for connecting said central hole (32) to said tobacco collecting unit (34), and a suction device (35) connected pneumatically to said conduit (31) to generate suction inside the conduit (31).

* * * * *